US006510924B2

(12) United States Patent
Bauer et al.

(10) Patent No.: US 6,510,924 B2
(45) Date of Patent: Jan. 28, 2003

(54) SPEECH-CONTROLLED LOCATION-FAMILIAR ELEVATOR

(75) Inventors: Georg Bauer, Aachen (DE); Thomas Portele, Bonn (DE); Lars Pralle, Korschenbroich (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/923,607

(22) Filed: Aug. 7, 2001

(65) Prior Publication Data

US 2002/0020586 A1 Feb. 21, 2002

(30) Foreign Application Priority Data

Aug. 8, 2000 (DE) ..... 100 38 518

(51) Int. Cl.[7] ..... B66B 1/16
(52) U.S. Cl. ..... 187/380; 187/391; 704/200
(58) Field of Search ..... 187/380, 381, 187/392, 395, 391; 381/110, FOR 111; 704/200, 275; 340/573.1

(56) References Cited

U.S. PATENT DOCUMENTS 4,403,114 A * 9/1983 Sakoe ..... 704/234
4,482,032 A 11/1984 Enriquez et al. ..... 187/29 R
4,558,298 A * 12/1985 Kawai et al. ..... 187/380
4,590,604 A * 5/1986 Feilchenfeld ..... 704/272
5,255,341 A * 10/1993 Nakajima ..... 340/573.1
5,952,626 A * 9/1999 Zaharia ..... 187/381
6,223,160 B1 * 4/2001 Kostka et al. ..... 187/380

FOREIGN PATENT DOCUMENTS

GB 2237410 A 8/1990 ..... B66B/1/14
JP 03098967 A * 4/1991 ..... B66B/3/00
JP 03238272 A * 10/1991 ..... B66B/1/14
JP 04191258 A * 7/1992 ..... B66B/1/18
JP 04327471 A * 11/1992 ..... B66B/1/14
JP 05004779 A * 1/1993 ..... B66B/1/14

* cited by examiner

*Primary Examiner*—Jonathan Salata

(57) ABSTRACT

Conventional elevators have a console for entering control information, via key depression. To make the known control arrangements simpler and more flexible to use by the user, the invention provides audio recording equipment and a speech analysis unit, while a control unit controls the elevator in accordance with entered speech commands. According to a further embodiment of the invention, speech commands also include indirect location descriptions which are assigned to floors via the database of the building. Also, a dialogue facility may be provided, for example, for commands that are not understood or are not unambiguous.

14 Claims, 1 Drawing Sheet

SPEECH-CONTROLLED LOCATION-FAMILIAR ELEVATOR

DESCRIPTION

Figure 1:
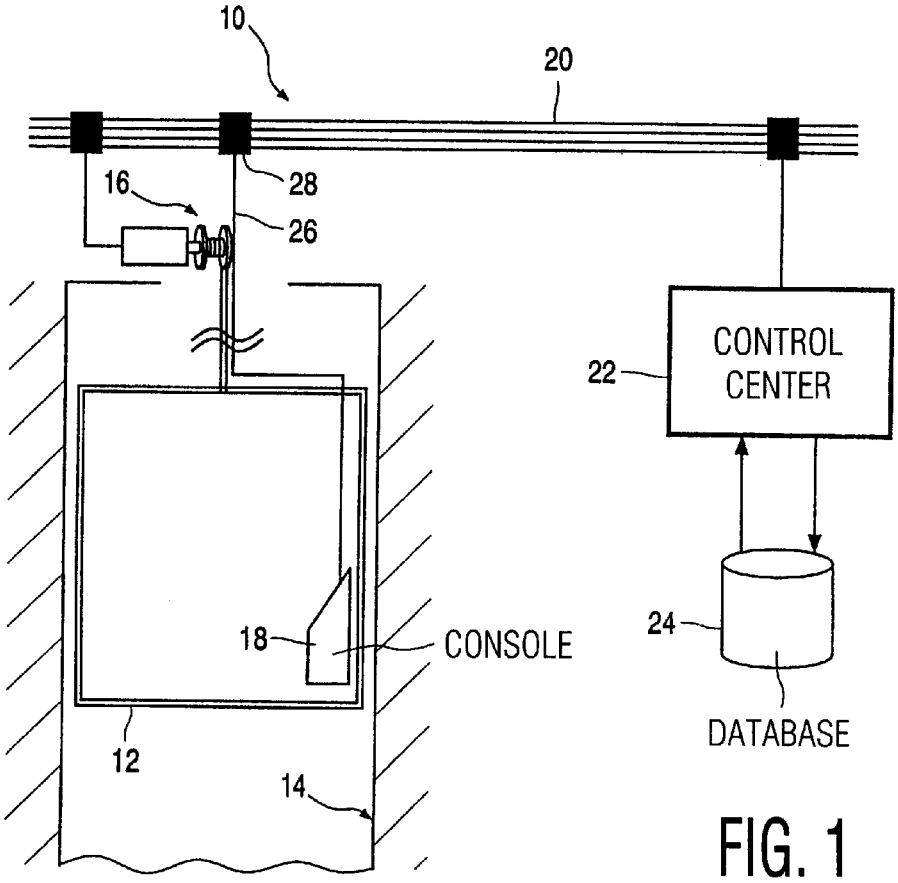

The invention relates to a control arrangement for an elevator, an elevator including such a control arrangement and to a respective control method.

Conventional elevators have a console for entering control information. Customarily, keyboard control panels are concerned and a key is assigned to each floor. The user then presses the key corresponding to the floor he wishes the elevator to move to. The elevator then moves to the respective floor.

The control arrangements for these known elevators are relatively simple to operate, it is true. But there are situations in which the operation is not easy for the users. For example, blind users first have to find the right key with the help of the lettering. More particularly, however, the user is always to know beforehand on what floor his desired destination is; for example, a person he or she is going to talk to, or also an office space.

It is an object of the invention to improve known control arrangements, elevators and control methods, so that the elevator is easier and more flexible to use for a user.

This object is achieved by a control arrangement for operating an elevator in accordance with various embodiments of the invention.

According to the invention a console comprises means for audio recording. A console is understood to mean in this context any terminal device in the elevator. Customarily, such terminal devices include acoustic and/or graphic indication elements and input possibilities (buttons, key switches, and so on). According to the invention, however, such a console may also have a very simple structure, in the simplest case it may include only audio recording means.

"Control information" is fed to such a console, that is, the user's entries which are to be used for controlling the elevator. Whereas this customarily takes place by pressing the button of the floor, according to the invention a user can control the elevator by speech commands.

For this purpose, an audio recording means is present, for example, a microphone, preferably with an arrangement for digitizing and signal coding. The concept of "recording" also refers to means by which audio signals can be accepted and processed. This comprises, on the one hand, recording in the way that first a block is recorded and stored, which is processed later on. On the other hand, also on-line signal processing of the converted audio signals is included, which can be effected without storage.

The recording means are connected to a speech analysis unit. The user can thus enter control information in the form of a speech command or a spoken question, respectively. The recorded (and, as the case may be, digitized or coded) audio signal is analyzed by the speech analysis unit i.e. the speech analysis unit tries to recognize the spoken words. Such speech recognition units are known per se. Needless to observe that a speaker-independent recognition system is preferred here.

The speech analysis unit produces a result in the form of a representation of the recognized speech commands or recognized word sequences, respectively. This information is processed in a control unit, so that the elevator is driven in accordance with the entered control information. A simple example: the speech analysis unit produces the words "second floor" as an analysis result of the audio recording. The control unit recognizes therefrom that the user has given the command to move the elevator to the second floor. The control unit accordingly controls the elevator, so that the elevator moves to the second floor.

The distinction between a speech analysis unit and a control unit is purely functional. The conversion may take place in two separate devices, but also in two modules of one device or even by a single program which runs on a computer and performs the two functions together.

According to a further embodiment of the invention, a control center is provided outside the elevator. Such a control center, which is connected to the console via transmission means, for example, a cable-bound bus system or wireless transmission means, for example, infrared or radio transmission means, will customarily be arranged as an electronic control circuit or computer, respectively.

It is possible for the speech analysis unit to be arranged on a console inside the elevator, with the speech analysis unit being directly connected to the recording means and the speech recording being analyzed immediately. It is also possible for the speech analysis unit to be arranged on a fixed position outside the elevator. In that case the audio recording is transmitted from the console to the speech analysis unit, preferably in digitized, coded form, while the transmission means already described could be used.

The latter variant is preferred here. On the one hand, for speech recognition there are pure software solutions which are suitable for being used on a central computer. On the other hand, "universal" speech recognition systems which cannot only recognize a limited vocabulary, but can analyze and recognize any conceivable speech entry are extremely expensive. A speech analysis unit is preferred that accesses a database which contains a limited number of possible speech commands.

Such a database is preferably made for the whole building. For example, the database can, on the one hand, be simply looked after centrally (for example, the name of a new employee may be entered). On the other hand, the control systems can access a database centrally for a plurality of elevators.

According to a further embodiment of the invention also the control unit accesses such a database, preferably the same database as the speech analysis unit. In this database is stored for each description of a location (control information, recognized speech command) the control command leading to this location. A simple example: In the database is stored for the speech command "second floor", on the one hand, the acoustic representation which the speech analysis unit accesses for recognition. Moreover, for the speech command "second floor" is also stored a respective control sequence that is to be sent to the elevator, so that this elevator moves to the second floor. After the recognition of the concept "second floor" on the basis of the audio representation, the control unit reads the stored control commands and sends them to the elevator.

According to an essential further embodiment of the invention, the speech commands recognized and processed as control information comprise not only indications of locations (for example, "second floor"), but also indirect descriptions of locations are understood. "Indirect" descriptions of locations are meant to be understood here such descriptions that are assigned to a location description via a combination. For example, a speech command "to Mr. Meier" is recognized. By evaluating a previously stored combination, it is established that Mr. Meier has a room on the third floor. Thus "to Mr. Meier" is an indirect location description for the third floor, so that the respective control commands are triggered.

The combination of such indirect location descriptions with a destination (floor) for the elevator is possible for very diverse information. This includes names of persons, department references and room numbers. Also function descriptions ("men's room", "conference room") can be combined to a floor number in this manner.

It is even possible to use momentary function descriptions. This includes, for example, rooms in which a certain event currently takes place (for example, "to the meeting of outdoor staff").

Preferably, these combinations are stored in a database where they are not stored for fixed, but may be changed. This includes, on the one hand, changes for the long term (for example, Mr. Meier moves house from the third to the fifth floor). On the other hand, also changes for the short term, for example, day by day changes, can be entered into the database.

Constant updates are advantageous particularly with indirect location descriptions. If the database dynamically updates this information, for example, also situations may be taken into account in which the assignment of indirect location descriptions change during the day. For example, the database may be updated, for example, if Mr. Meier (who otherwise works in the second floor) is at a meeting in the conference room (third floor). The indirect location description "Meier" then shows the third floor instead of the second floor. These constant updates are particularly interesting in buildings in which the persons working there are dynamically assigned an office space every day.

Particularly in those cases, but also in other cases where inquiries or additional information is helpful or necessary, the capability of the system of holding a dialogue is advantageous. For example, in the case of entries that are not understood a further inquiry may be made ("Please repeat the entry"), or further details may be asked for in case of unclear commands ("Do you mean Hans Müller of bookkeeping or Hans Müller of the board?"). But especially information can be given after a location indication has been understood ("Mr. Müller is in room 12, at the end of the corridor on the right") or decisions of the user may be asked for ("Mr. Müller is in the conference room. Would you like to take part in the conference or wait in his office?").

A control system according to the invention and reacting to natural speech entries may obviously be used with key control in parallel with the present systems. The key control is then preferred to have priority, so that speech entries (especially erroneously understood speech entries) can be overwritten.

These and other aspects of the invention are apparent from and will be elucidated with reference to the embodiments described hereinafter.

Figure 2:
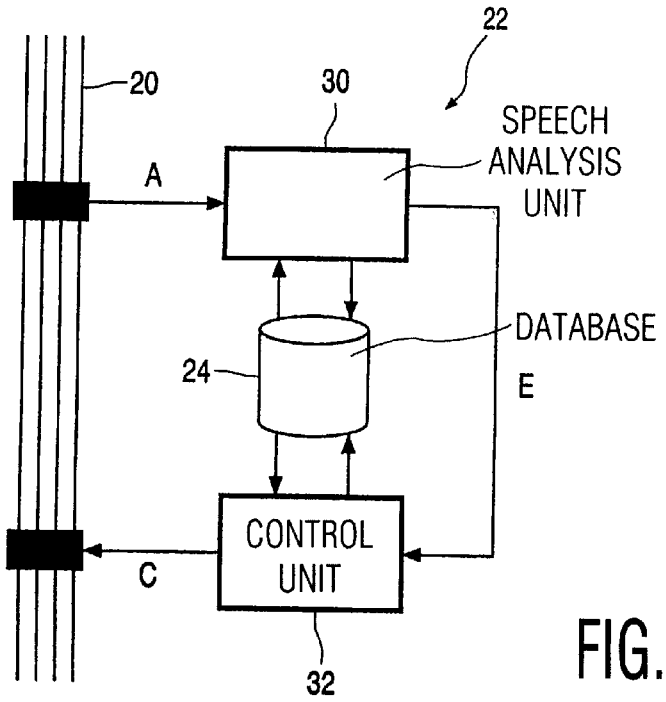

In the drawings:

FIG. 1 gives a diagrammatic representation of an elevator system with a bus link to a control center; and FIG. 2 gives a diagrammatic representation of the components of a control center.

FIG. 1 diagrammatically shows a control arrangement 10 for an elevator. The elevator cage 12 moves in an elevator shaft 14 while it is moved by a driving arrangement 16 (here symbolically shown as a cable winch). A console 18 is arranged inside the elevator cage 12.

The building has a house bus 20. The house bus 20 is shown only symbolically here. Apart from current line-bound bus systems, house bus 20 may alternatively or concurrently implemented by a wireless transmission technique, such as, for example, Bluetooth™. The console 18 is connected to this house bus 20, as is the driving arrangement 16. A control center 22, which has access to a database 24, is also connected to the house bus 20. The control center 22 is a central computer which further controls units in the building in addition to controlling the elevator.

The components are interconnected in the following fashion: The console 18 comprises a speech recording unit (not shown), which includes a microphone, an A/D converter for digitizing the audio data and an encoder module for coding the digital data into a current audio format, for example, PCM. The console 18 is connected to a bus interface 28 via a data line 26. Via the data line 26 and the bus interface 28 the recorded and coded audio data are transmitted to the house bus 20. The audio data are transmitted to the control center 22 over the house bus.

The control center 22 is shown in detail in FIG. 2. It comprises a speech analysis unit 30 and a control unit 32. The audio data A are read from the house bus 20 and analyzed in the speech analysis unit 30. This unit 30 is an electronic circuit or a computer, respectively, with a respective analysis program in which algorithms for speaker-independent speech recognition are used.

There are many algorithms and methods for speech recognition products, whereas suitable ready-made products can be used for the concrete application. Examples of this are simple command and control recognizers such as the VoCon product made by Philips, which can recognize a very limited vocabulary of fixedly predefined speech commands. But also complex recognizers, such as the Freespeech software product made by Philips, are known which can understand continuously spoken speech and have a speech model at their disposal as well as a vocabulary of several tens of thousands of words. Finally, recognition systems that can hold dialogues, for example, speech-controlled user guides for telephony applications can be employed.

The speech analysis unit 30 accesses the database 24. The vocabulary to be recognized by the speech analysis unit 30 is stored in the database 24. It contains direct names of locations such as "first floor", relative location descriptions such as "one floor up, and indirect location descriptions such as "to the conference room".

The distinction between the speech analysis unit 30 and the control unit 32 is purely functional here. In the concrete example, the control center 22 is a central computer including speech analysis unit 30 and control unit 32 as software modules arranged outside of the elevator cage 12. Alternatively, the speech analysis unit 30 can be arranged within the elevator cage 12.

In the following the functioning of the control will be explained with reference to an example: A user enters an elevator and gives the speech command "to Mr. Meier please". The speech command is recorded inside the console 18, digitized and coded and, subsequently, sent over the data line 26 and the bus interface 28 over the house bus 20 to the control center 22. In the control center 22 the respective audio data are read out and subjected to a speech analysis by the speech analysis device 30. The latter recognizes the words "to" "mister" "Meier" and "please" on the basis of the vocabulary stored in the database 24, and sends them in digitized form (for example, tokens) as a signal E to the control unit 32. The control unit 32 performs a simple syntactic analysis of the recognized word sequence and removes the redundantly recognized "to" as well as the addition "please". As an (indirect) description of location it recognizes "Mr. Meier". It retrieves from the database 24 the location information combined with the key of "Mr. Meier". Since Mr. Meier works on the third floor, a control command C is read from the database, is sent over the house bus 20 to the driving unit 16, so that the elevator moves to the respective floor. The result "third floor" is shown to the user by a respective display field on the console lighting up, so that the user recognizes that his speech command has been understood.

Thus, this is a "location-familiar" elevator to which commands can be given via a natural speech interface, which commands are converted into floor information by the control system via the database of the building and carried out.

In an extension of the system the system is also capable of holding dialogues. For this purpose, a speech output system is integrated with the console. This is either a system for synthetic speech output, in which the words to be output are transmitted as text by a dialogue unit. Or a D/A converter is concerned, with loudspeaker attached, so that words sent as audio data by the dialogue unit are output.

The dialogue unit is also arranged in the control center 22. The dialogue unit evaluates the recognized speech commands. When they cannot be assigned at all or not assigned unambiguously, the dialogue unit queries the user. For this purpose, it controls the speech output system in the console 18 via the house bus 20, so that this system addresses the further inquiry to the user. Only when the command can be assigned unambiguously is it transferred to the control unit for the respective activation.

The dialogue unit can also take over more complex tasks of the organization while accessing a respectively constantly updated database. For example, it can establish that, for example, Mr. Müller has his office on the second floor, but is at a meeting on the third floor at the time. It can announce this to the user, give various reactions to be selected from, and cause the appropriate thing to do, for example, if the user would like to wait in Mr. Müller's office, inform Mr. M üller thereof.

Further extensions to this system comprise especially the following items: The console can comprise not only means for speech output, but also other acoustic or graphic indication elements. Such indication elements in the elevator may also be used for delivering further information about the destination. For example, a further indication, for example, direction information "the room is at the end of the corridor on the right" may then be given when the elevator is being left. A printer may also print a route description taken along by the user.

The voice interface can be activated automatically when a person enters the elevator. This may be detected by means of the photoelectric barrier or by the change of weight. The user may be invited to enter his speech command by a respective display (speech indication or graphic display).

The audio functions of the console may also be used for establishing a communication link for a malfunctioning of the elevator. More particularly, respective requests or calls for help of the user may belong to the vocabulary of the speech recognition device 30, so that an emergency signal is triggered automatically when these commands are recognized.

What is claimed is:

1. A system for operating an elevator cage having a console (18) for receiving a speech command (A) from a user of the elevator cage (12), said control center (22) comprising:

a database (24) operable to store a control command (C) corresponding to the speech command (A);

a speech analysis unit (30) operable to analysis the speech command (A) and to provide analysis data (E) indicative of a result of the analysis of the speech command (A); and a control unit (32) operable to retrieve the control command (C) from said database (24) in response to a reception of the analysis data from said speech analysis unit (30), said control unit (32) further operable to control an operation of the elevator cage (12) in accordance with the control command (A).

2. The system of claim 1, wherein said database (24) is arranged at a spot outside the elevator cage (12).

3. The system of claim 1, wherein said speech analysis unit (30) is arranged at a spot outside the elevator cage (12).

4. The system of claim 1, wherein said control unit (32) is arranged at a spot outside the elevator cage (12).

5. A system for operating an elevator having a console (18) for receiving a speech command (A) of an indirect location type from a user of the elevator, said control center (22) comprising:

a database (24) operable to store a vocabulary of indirect location descriptions;

a speech analysis unit (30) operable to analysis an indirect location description within the speech command (A) and to provide analysis data (E) indicative of a result of the analysis of the indirect location description; and a control unit (32) operable to control an operation of the elevator in response to a reception of the analysis data from said speech analysis unit (30).

6. The system of claim 5, wherein said database (24) is further operable to store a control command (C) corresponding to the speech command (A); and wherein said control unit (32) is further operable to retrieve the control command (C) from said database (24) in response to a reception of the analysis data from said speech analysis unit (30) to thereby control the operation of the elevator in accordance with the control command (C).

7. The system of claim 5, wherein said database (24) is arranged at a spot outside the elevator cage (12).

8. The system of claim 5, wherein said speech analysis unit (30) is arranged at a spot outside the elevator cage (12).

9. The system of claim 5, wherein said control unit (32) is arranged at a spot outside the elevator cage (12).

10. A system for operating an elevator having a console (18) for receiving a speech command (A) of relative name type from a user of the elevator, said control center (22) comprising:

a database (24) operable to store a vocabulary of relative location descriptions;

a speech analysis unit (30) operable to analysis a relative location description within the speech command (A) and to provide analysis data (E) indicative of a result of the analysis of the indirect location description; and a control unit (32) operable to control an operation of the elevator in response to a reception of the analysis data from said speech analysis unit (30).

11. The system of claim 10, wherein said database (24) is further operable to store a control command (C) corresponding to the speech command (A); and wherein said control unit (32) is further operable to retrieve the control command (C) from said database (24) in response to a reception of the analysis data from said speech analysis unit (30) to thereby control the operation of the elevator in accordance with the control command (C).

12. The system of claim 10, wherein said database (24) is arranged at a spot outside the elevator cage (12).

13. The system of claim 10, wherein said speech analysis unit (30) is arranged at a spot outside the elevator cage (12).

14. The system of claim 10, wherein said control unit (32) is arranged at a spot outside the elevator cage (12).

* * * * *